US005992096A

United States Patent [19]

De La Cerda et al.

[11] Patent Number: 5,992,096

[45] Date of Patent: Nov. 30, 1999

[54] CONTROLLABLE PET ACCESS SYSTEM

[75] Inventors: Paul De La Cerda, Sylmar, Calif.; Brian R. Smith, Collinsville, Okla.

[73] Assignee: Pooch Pass, Inc., Tulsa, Okla.

[21] Appl. No.: 09/174,665

[22] Filed: Oct. 19, 1998

[51] Int. Cl.[6] ..... E05D 15/48

[52] U.S. Cl. ..... 49/169; 160/180

[58] Field of Search ..... 49/31, 169, 168, 49/163; 160/2, 116, 180

[56] References Cited

U.S. PATENT DOCUMENTS 4,022,263 5/1977 Beckett et al. ..... 160/180 X 4,497,133 2/1985 Blenkinsop ..... 49/169 X 4,991,350 2/1991 Kirk ..... 49/169

5,196,826 3/1993 Whiting ..... 49/31 X

*Primary Examiner*—Daniel P. Stodola

*Assistant Examiner*—Hugh B. Thompson

*Attorney, Agent, or Firm*—Frank L. Hart

[57] ABSTRACT

A controllable animal access system connectable to the door of a building which has an opening covered by a pivotally moveable animal door. The animal access system has a motion detector associated with a reader which detects an encoded pet tag worn by a selected animal and actuates locking and unlocking mechanisms in response to reading an accepted code. Various other controls are provided for operation of the apparatus.

15 Claims, 3 Drawing Sheets

CONTROLLABLE PET ACCESS SYSTEM

TECHNICAL FIELD OF THE INVENTION

The present invention relates to apparatus for controllably providing animals ingress and egress to a building. More particularly, the pet or animal must possess an encoded tag which is coded to a reader of the system in order to actuate the system.

BACKGROUND OF THE INVENTION

It is generally felt by the public that pets are a big nuisance. They demand considerable attention, require repetitive trips to their outside bathrooms, seem to enjoy back yards, but must continuously return inside to apparently determine if anything has changed in the last few minutes. Irrespective of the bother and annoyance they cause, the public at large is in love with their pets.

In order to increase the joy/work ratio associated with pet ownership, various apparatus have been devised for permitting ingress and egress of the pets. Early apparatus consisted of a pivotally moveable pet door associated with an outside door of the house. With this apparatus, the pets soon learned to push their way through the door as they desired. However, operation of this system were also soon learned by undesirable visiting racoons, opossums, and rodents.

This invention therefore relates to apparatus with provides the functions of earlier devices, but contains the capability of providing controlled access to a particular animal while eliminating the possibility of entry by other unselected animals.

SUMMARY OF THE INVENTION

In one aspect of the invention, a controllable animal access system is connectable to the door of a building. The building door has an opening therethrough.

An animal door of a size sufficient to cover the building door opening is pivotally connectable to the building door and moveable between an open position and a closed position. A motion detector is adapted to detect movement adjacent the animal door and deliver a first signal "A" in response to said detected movement. An encoded animal tag is provided.

At least one solenoid having a locking bar is connectable to the building door adjacent the animal door. The solenoid is also connectable to the motion detector and is adapted to receive a third signal "B". The locking bar is moveable between a normally locked position at which the locking bar is contacting the animal door and maintaining said animal door in a locked position and an open position at which the locking bar is spaced from the animal door in response receiving signal "B".

A reader is connectable to the solenoid and to the motion detector. The reader is actuated in response to receive receiving signal "A" and is adapted to deliver a scanning signal and receive a return signal from the encoded animal tag. Responsive to receiving the return signal from the encoded animal tag, the reader delivers signal "B" to the solenoid.

A power source is connectable to the motion detector, the solenoid, and the reader. A timer is operably connectable to the solenoid and the reader and adapted to terminate power to the solenoid and reader a preselected time delay after delivery of signal "B".

BRIEF DESCRIPTION OF THE DRAWINGS

A more complete understanding of the invention and its advantages will be apparent from the detailed description taken in conjunction with the accompanying drawings in which.

DETAILED DESCRIPTION OF THE INVENTION

Figure 1:
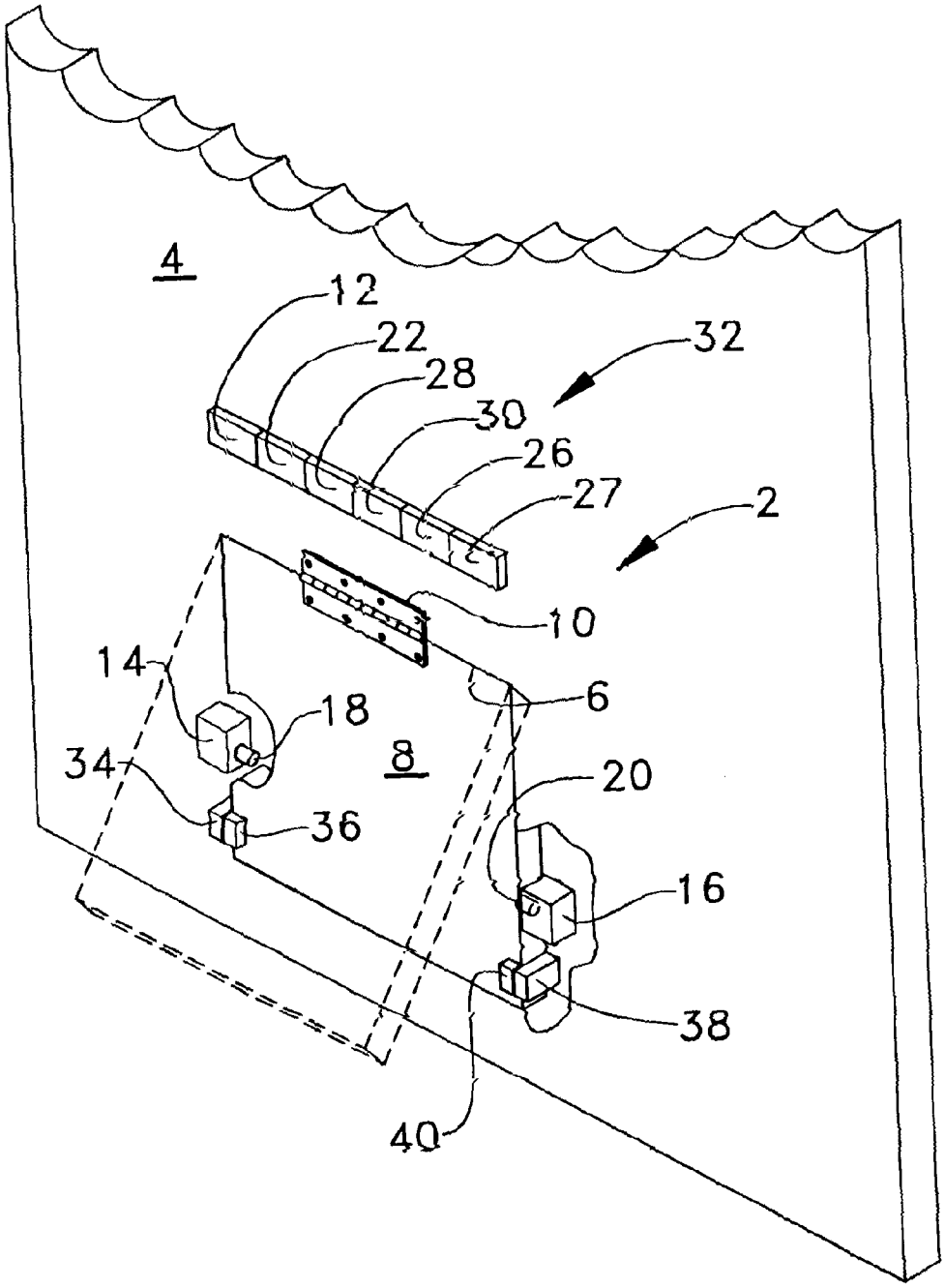
FIG. 1 is a diagrammatic frontal view of the apparatus of this invention.

Referring to FIG. 1, the controllable pet or animal access system 2 of this invention is connect able to the door 4 of a building. The building door 4 has an opening 6 therethrough. For purposes of brevity, the animal will hereafter more often be referred to as a pet.

An animal or pet door 8 is provided which is of a size sufficient to cover the opening 6 of the building door 4. The pet door 8 is pivotally connectable to the building door 4 by hinge 10 and is moveable between an open position, shown by broken lines, and a closed position, shown by solid lines.

For purposes of simplicity, FIG. 1 only shows by broken lines the pet door 8 swinging outwardly for egress of a pet. It should be understood that the pet door 8 is also constructed to swing inwardly for ingress of a pet.

A motion detector 12 is connectable to one of the doors 4,8 or adjacent building structure, preferably to the building door 4, and is adapted to detect movement adjacent the pet door 8 and deliver an actuating signal "A" in response to said detected movement.

At least one solenoid 14, preferably a pair of solenoids 14,16 are connectable to the building door 4 adjacent the pet door 8 and connectable to the motion detector. The solenoid or solenoids 14,16 are adapted to receive a hereafter signal "B". Each of the solenoids 14,16 have a respective locking bar 18,20. The locking bars 18,20 are moveable between a normally locked position at which the locking bars 18,20 are contacting the pet door 8 and maintaining the pet door 8 in a closed and locked position and an open position at which the locking bars 18,20 are spaced from the pet door 8 and the pet door 8 is free to move to an open position. Movement of the locking bars 18,20 to the open position is in response to receiving signal "B".

A reader 22 is connectable to the solenoids 18,20 and to the motion detector 12. The reader is actuated in response to receiving signal "A" from the motion detector 12. The reader is adapted to deliver a scanning signal and receive a return signal from an encoded pet tag 24 and responsively deliver signal "B" to the solenoids 14,16 in response to receiving a correct and preselected return signal from the pet tag 24.

A timer 26 is operably connectable to the solenoids 14,16 and the reader 22 and adapted to terminate power to the solenoids 14,16 and reader 22 a preselected time delay after delivery of signal "B". In response to termination of solenoid power, the solenoids return to the locked position thereby locking the pet door 8 to the building door 4. A power source 27 for the apparatus of this invention can be provided to the associated apparatus by battery or 110 volt house power. Preferably the apparatus will utilize battery power to operate the motion detector 12, solenoids 14,16, reader 22 and hereafter more fully disturbed timed controlled devices.

It should be noted that by controllably terminating power to the solenoids 14,16 and reader 22, a preselected time interval after actuation of the solenoids 14,16, power is conserved as is wear and tear of the apparatus.

In one embodiment of this invention, a control switch 28 is connectable to the motion detector 12, the reader 22, and the solenoids 14,16 and is adapted for manual disabling the solenoids. In another embodiment of this invention, a time clock 30 can be connected to the control switch 28 and provide an automatic function of freeing the pet door for locking and unlocking at preselected timed intervals.

Figure 2:
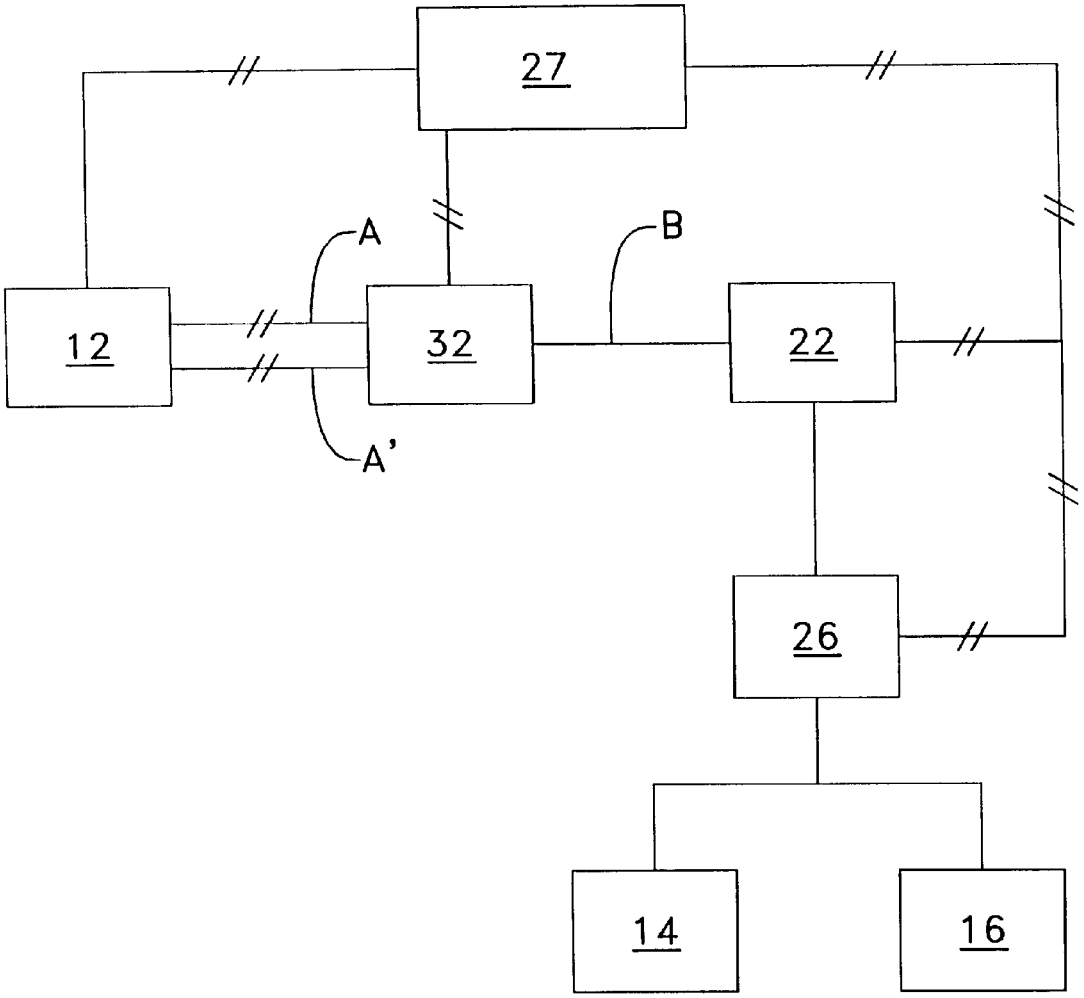
FIG. 2 is a diagrammatic view of the controlling elements of this invention.

In the preferred embodiment of this invention, as shown in FIGS. 1 and 2, a switching system 32, consists of the control switch 28, and the time clock. First signal "A" and second signal "A'" are deliverable by the motion detector. In this preferred system, signal "A" is delivered to the switching system 32 in response to motion detected only on the outside of the pet door 8 and signal "A'" is delivered to the switching system 32 in response to motion detected only on the inside of the pet door 8. The switching system 32 has a plurality of settings which can be preselected for providing additional control of pet door operation and thereby more completely control the family pet.

The switching system 32 settings can be adapted to selectively interrupt signals "A" and "A'" and responsively free solenoid actuation in response to delivery of only signal "A", only signal "A'", either one of signals "A" and "A'", and selectively interrupt all incoming signals from the motion detector system.

By use of this switching system 32, operation of the times during the day in which ingress and egress can be obtained by the pet, and additionally the access mode can be controlled. Operation examples are as follows:

Only incoming pets permitted use of the pet door;

Only outgoing pets permitted use of the pet door;

Both incoming and outgoing pets permitted use of the pet door;

Neither incoming nor outgoing pets permitted use of the pet door; and

Each of these modes can be further limited to specific periods during a day.

Although this invention is primarily used for ingress and egress of pets, it should also be understood that it can be used for controlling the movement of security animals, zoo animals, farm animals, and others. In such uses, this invention might have the opening for the animal formed in a wall, as opposed to being formed in a building door.

The motion detector 12 of this invention is preferably sized to detect movement of relatively small animals normally maintained as pets at a distance in the range of about 2 to about 10 feet from the motion detector 12, more preferably at about 5 feet from the motion detector 12. The motion detector 12 detects motion on opposed sides of the door 4 and actuates the reader 22 to send out and receive signals "A and A'" from respective opposed sides of the door 4, as described above.

In order to assure complete closure of the pet door 8 and alignment of the solenoid locking bars 18,20 in respective holes of the pet door 8, it is preferred that at least one pair, preferably two pairs of magnets 34,36 and 38,40 be utilized. A first magnet 34,38 of each pair will be connectable to the building door 4 and a second magnet 36,40 of each pair will be connectable to the pet door 8 adjacent a respective first magnet 34,38 and oriented relative one to the other for attracting one another.

Figure 3:
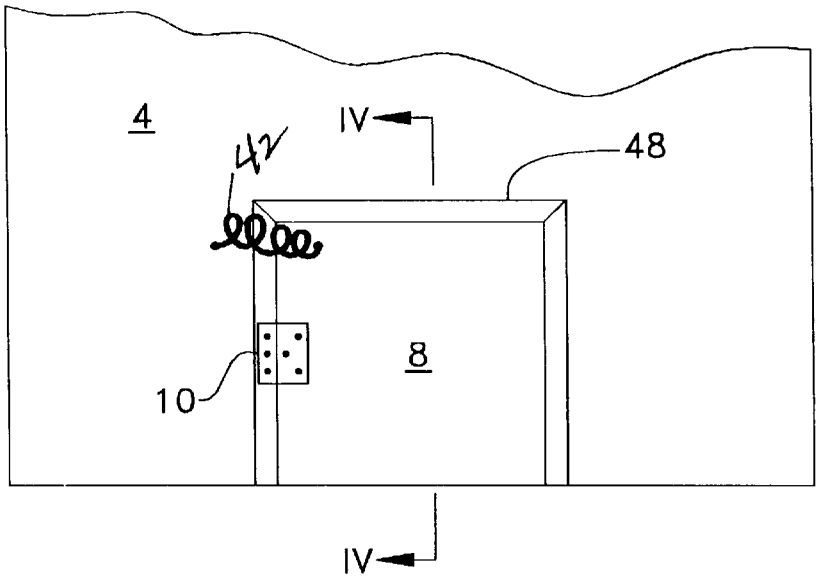
FIG. 3 is a diagrammatic view of another embodiment of the pet or animal door of this invention.

It should be understood that other pet door aligning mechanisms can be utilized without departing from this invention. Referring to FIG. 3, the pet door 8 of this invention is hinged at the side of the pet door 8 and the aligning mechanism is a coil spring 42, for example.

Figure 4:
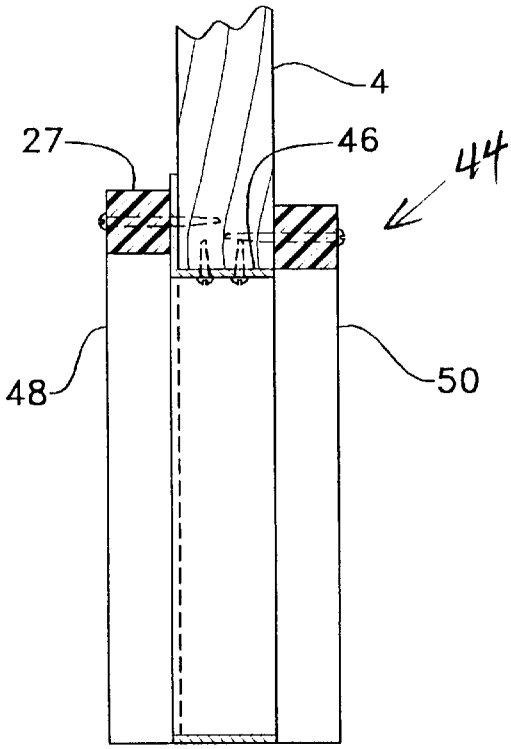
FIG. 4 is a diagrammatic side view of the framing system of this invention.

Referring to FIG. 4, it is preferred that a framing system 44 be used to provide support for the apparatus of this invention and to provide a more pleasing appearance.

The framing system 44 can consist of a metal flange system 46 extending about the opening 6 of the building door 4 and being connectable to said building door 4 by screws, bolts or other means known in the art. The metal flange system 46 preferably is slidably position able through the building door opening 6 and the motion detector 12, reader 22, power source 27 and timers with associated switching systems (if any) are likewise connected thereto.

First and second trim covers 48,50, preferably formed of paintable organic plastic are connectable to opposed respective sides of the building door 4 about the opening 6 thereof.

Figure 5:
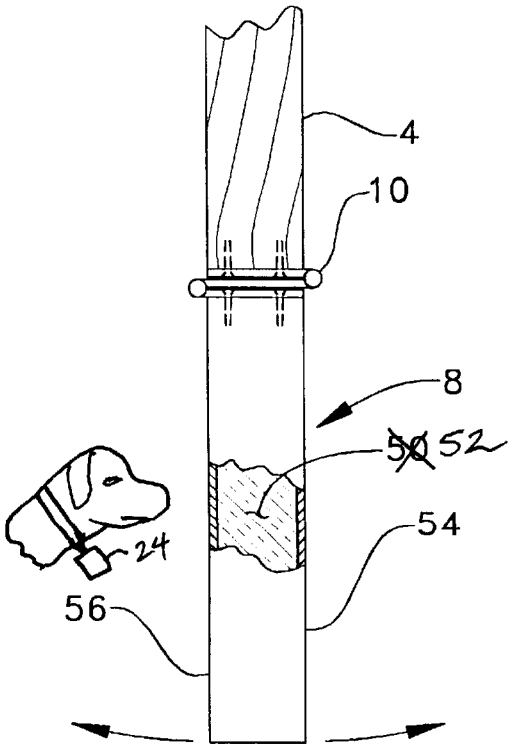
FIG. 5 is diagrammatic side view in partial section of the pet or animal door of this invention.

Referring to FIG. 5, the pet door 8 has insulation 52 sandwiched between inner 54 and outer 56 surfaces of the door 8. In order to provide further thermal efficiency, a thermal barrier 58, formed of for example nylon pile, extends about the peripheral outer edge of the pet door 8.

Industrial Applicability

In the operation of the apparatus of this invention, the encoded pet tag is placed on or within a collar of the pet. As the pet moves toward the building door 4 to get in or out, the motion detector 12 delivers a signal to the reader 22 and thereby actuates the reader 22 which sends out a scanning signal and receives a return signal. If the code of the return signal is acceptable, the reader 22 delivers a signal "B", through a timer 26 to solenoids 14,16. The solenoids 14,16 are thereby actuated to retract their respective locking bars 18,20 and free the pet door 8 for pivotal movement in response to the identified pet pushing against the pet door 8.

In response to receipt of signal "B", timer 26 is actuated and, after a preselected period, interrupts power to the solenoids 14,16 which resultingly causes the locking bars 18,20 to return to the locked position. This time period is selected of a sufficient duration that a trained pet will be through the door by time termination.

By this system, only the identified pet passed through the pet door 8 and the pet door 8 is shortly thereafter locked.

The switching system 32, as explained above, provides further control over pet ingress and egress.

Other aspects, objects and advantages of this invention can be obtained from a study of the drawings, the disclosure, and the appended claims.

What is claimed is:

1. A controllable animal access system connectable to the door of a building, said door having an opening therethrough, comprising:

an animal door of a size sufficient to cover the building door opening and being pivotally connectable to said building door and moveable between an open position and a closed position;

a motion detector system adapted to detect movement adjacent the outside of said animal door and deliver a first signal in response to said detected movement and to detect movement adjacent the inside of said animal door and deliver a second signal in response to said detected movement;

an encoded animal tag;

at least one solenoid having a locking bar and being connectable to the building door adjacent the animal door and connected to the motion detector system and adapted to receive a third signal, said locking bar being moveable between a normally locked position at which the locking bar is contacting the animal door and maintaining said animal door in a closed and locked position and an open position at which the locking bar is spaced from the animal door in response to receiving said third signal;

a switching system connected to the motion detector system and adapted to selectively interrupt the first and second signals and responsively free solenoid actuation in response to the delivery of only the first signal, only the second signal, either one of the first and second signals, and selectively interrupt all signals from the motion detector system;

a reader connected to the solenoid and to the motion detector via the switching system, said reader being actuated in response to receiving at least one of the first and second signals and being adapted to deliver a scanning signal and receive a return signal from the encoded animal tag and responsively deliver said third signal to the solenoid in response to receiving the return signal from the encoded animal tag;

a power source connectable to the motion detector, the solenoid, the switching system and the reader; and a timer operably connected to the solenoid and the reader and adapted to terminate power to the solenoid and reader a preselected time delay after delivery of the third signal.

2. A controllable animal access system, as set forth in claim 1, including a manual control switch connected to the system and being adapted to disable the solenoid.

3. A controllable animal access system, as set forth in claim 2, including a time clock connected to the control switch and adapted to disable the solenoid at preselected timed intervals.

4. A controllable animal access system, as set forth in claim 1, including a first magnet connected to the building door; and a second magnet connected to the animal door adjacent said first magnet, said magnets being oriented relative one to the other for attracting one another.

5. A controllable animal access system, as set forth in claim 1, including a framing system connectable about the opening of the building door and adapted to support the motion detector, reader, power source, and timer.

6. A controllable animal access system, as set forth in claim 5, wherein the framing system includes a metal flange system connectable to and extending about the opening of the building door; and first and second trim covers connectable to opposed sides of the building door about the opening of said building door.

7. A controllable animal access system, as set forth in claim 6, wherein the first and second trim covers of the framing system are formed of organic plastic.

8. A controllable animal access system, as set forth in claim 6, wherein the metal flange system of the framing system is connectable to and supports the motion detector, reader, power source and timer.

9. A controllable animal access system, as set forth in claim 1, including a second solenoid associated and operable with the other solenoid, said solenoids being positionable on opposed sides of the animal door and wherein the animal door is pivotally connectable to the building door at an upper edge of the animal door.

10. A controllable animal access system, as set forth in claim 1, wherein the animal door is pivotally connectable to a side of the building door opening and including a spring connectable to the building and animal doors and being adapted to urge the animal door toward the closed position.

11. A controllable animal access system, as set forth in claim 1, wherein the power source is at least one battery.

12. A controllable animal access system, as set forth in claim 1, wherein the motion detector is adapted to sense motion of an animal a distance in the range of about 2 to about 10 feet from the motion detector.

13. A controllable animal access system, as set forth in claim 1, wherein the power source is 110 volts.

14. A controllable animal access system, as set forth in claim 1, wherein the animal door is an insulated door and edges of the animal door include a thermal barrier.

15. A controllable animal access system, as set forth in claim 14, wherein the thermal barrier if formed of nylon pile.

* * * * *